United States Patent [19]

Ogata et al.

[11] 4,259,771

[45] Apr. 7, 1981

[54] APPARATUS FOR PRODUCING HEAT TRANSFER TUBE

[75] Inventors: Masami Ogata; Yuji Nakatsuka, both of Hirakata, Japan

[73] Assignee: Nishiyodo Air Conditioner Co., Ltd., Osaka, Japan

[21] Appl. No.: 22,796

[22] Filed: Mar. 22, 1979

[30] Foreign Application Priority Data

Mar. 24, 1978 [JP] Japan ..... 53/34392

[51] Int. Cl.[3] ..... B21F 21/00; B21C 37/22

[52] U.S. Cl. ..... 29/33 F; 29/157.3 AH; 113/118 A; 165/184

[58] Field of Search ..... 29/33 F, 157.3 AH, 33 T, 29/33 D; 165/184; 113/118 A

[56] References Cited

U.S. PATENT DOCUMENTS

| | | | |
|---|---|---|---|
| 3,397,440 | 8/1968 | Dalin | 165/184 X |
| 3,550,235 | 12/1970 | Jarvis et al. | 113/118 A X |
| 3,789,786 | 2/1974 | Wiedenmann | 29/157.3 AH X |
| 3,856,079 | 12/1974 | Geppelt | 165/184 |
| 4,079,611 | 3/1978 | Osterkorn | 29/157.3 AH |

*Primary Examiner*—William R. Briggs

*Attorney, Agent, or Firm*—Blanchard, Flynn, Thiel, Boutell & Tanis

[57] ABSTRACT

Apparatus for efficiently producing a wire fin tube for heat transfer which comprises fin-forming means for shaping a plurality of wires to a wavy shape, said fin-forming means including a pair of gears; means for guiding the wavy wires in an upstanding state including guide plates spaced apart a selected distance; means for feeding a revolving tube in a crossing direction, to the wavy wires so that the wires can be wound on the tube; means for controlling the operative speed relation of the fin forming means and the tube feeding means so that the wavy wires may be helically wound on the tube under a moderate tension so as to maintain the upstanding state and the same pitch as the distance of the guiding means; and means for welding the wire fins to the tube.

5 Claims, 5 Drawing Figures

APPARATUS FOR PRODUCING HEAT TRANSFER TUBE

This invention relates to an apparatus designed for highly efficiently producing a wire fin tube for heat transfer in which wire fins are helically wound around and secured to the tube body.

A fin tube for heat transfer is generally used as a heat exchanger, particularly a condenser, an evaporator or the like for refrigeration machinery. Heretofore, various fin tubes for heat transfer have been provided and used, for example, an aerofin tube in which an elongated sheet or belt is helically wound around the tube; an Edward fin tube having petal-shaped fins in which a band or belt is helically wound around the tube to form the petal-like fins; low fin tube in which the tube surface is processed by form rolling to impress grooves thereon; etc.

The aerofin tube is likely to cause film condensation when it is used as a heat exchanger for condensation. That is, vapor first condenses in a film form on the top surfaces of the fins, and the condensed liquid film descends gradually as more condensation occurs on the liquid film and the condensate eventually forms large films or droplets covering the tube body. The increase in the thickness of the liquid film, which parameter is inversely proportional to the coefficient of heat conduction, inevitably results in a decrease in the coefficient of heat conduction. Hence, the film condensation phenomenon eventually diminishes the thermal exchange efficiency of the fin tube.

On the other hand, the Edward fin tube has a lower thermal exchange efficiency as compared with the aerofin tube, since the space surrounded by the petal fins and the tube surface cannot be effectively utilized as a heat exchange area. This type of fin tube has a further drawback in that, when it is used as a shell and tube type condenser, a dew-like liquid film is produced, which leads to lowering in the coefficient of heat conduction and accordingly, a decrease in the coefficient of heat transfer.

Further, the low fin tube requires that the tube body be made of a tube material having a large thickness so that grooves can be formed on the tube surface. Consequently, a larger amount of material is required for the production of the flow fin tube, which is not desirable from the viewpoint of saving resources and naturally entails an increase in cost.

There is further proposed a wire fin tube in which the wire is welded to the tube simultaneously with the process of continuously forming arched fins one by one. With this wire fin tube, however, not only are there drawbacks incident to the processing, for example, the fin is liable to collapse on winding, the processing speed is low and it is not feasible to process fins of a low height, but also, the fins thus wound are not firmly fixed to the tube. On account of this, the wire fin tube cannot be used as a tube-in-tube type heat exchanger. Moreover, the wire fins, when processed on a corrugated tube, are not firmly fixed thereon owing to the smaller contact area of the root portions with the tube surface than is the case with a smooth tube.

Drawbacks that are common to the prior art devices or apparatuses used for the processing and manufacture of the prior art fin tubes, as described above, are the low speed or low efficiency of the production and the difficult processibility.

Accordingly, a principal object of this invention is to provide an apparatus designed for producing a wire fin tube for heat transfer, according to which the production efficiency and processing speed are remarkably improved, and the processibility is significantly improved.

A further object of this invention is to provide an apparatus for the manufacture of a wire fin tube for heat transfer, according to which good heat transfer properties can be ensured to the fin tube.

The other objects of this invention will appear from the description hereinbelow.

According to the apparatus of this invention, a fin tube is produced highly efficiently and at high processing speed by the sequential steps of: while feeding a revolving copper tube, as a tube body, in an axial direction, coating solder on the surface of the copper tube, winding helically a plurality of wire fins around the tube, welding and fixing the wire fins to the tube by melting the solder by heat treatment, and cooling the resulting fin tube, while washing if required. The fin windng step is particularly important. More specifically, as shown in FIG. 1, a wire having good thermal conductivity, for example, hard copper wire (W), is bent or curved to shape a wavy or sinuous wire (1) in which alternately recurring patterns of an arch-shaped crest portion ($\mathbf{1}_a$) and a root or bottom portion ($\mathbf{1}_b$) extend in a straight line in the same plane. A plurality of the wavy wires (1) spaced apart a predetermined distance from each other are delivered together, with the arch-shaped portions ($\mathbf{1}_a$) of the respective wires being arranged upright and in parallel alignment with each other, and that are wound helically around the surface of the revolving tube (2) while maintaining the upright condition of the arch-shaped portions ($\mathbf{1}_a$). Simultaneously with the winding, the root or bottom portions ($\mathbf{1}_b$) of the wavy wire fins are welded to the tube surface to form a wire fin tube (3) for heat transfer, in which many wire protrusions in the form of arches are distributed in the upright state all over the surface of the tube body.

During winding, it is preferred to impose an adequate tension on the wavy wires (1) so as to obtain wire fins that are fixed firmly and stably to the tube without collapse. The application of such tension renders the upstanding arch portions of the wavy wires resilient and tough due to the fact that both the legs of each of the arch-shaped portions are imparted with considerable rebound resilience and the root bottom portion is fixed not directly but rather through the solder layer to the tube face.

The apparatus of this invention for performing the process above will be described hereinafter with reference to the accompanying drawings, in which.

Figure 1:
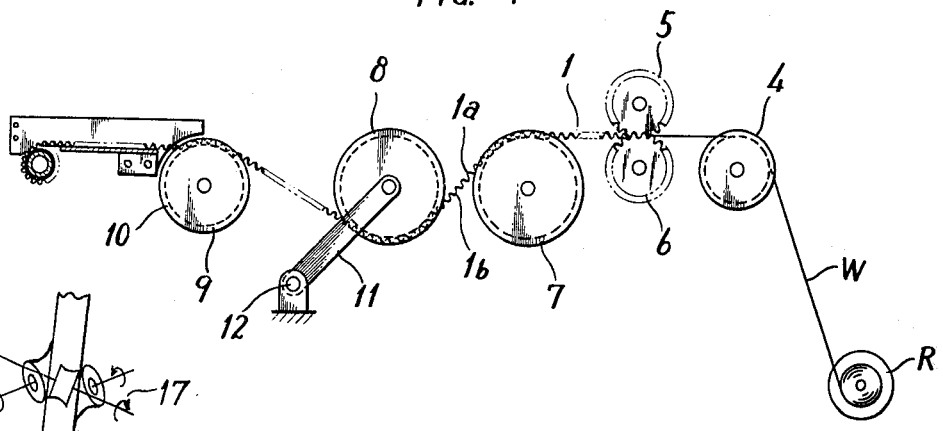
FIG. 1 is a schematic elevational view showing the substantial part of the apparatus of this invention.
Figure 2:
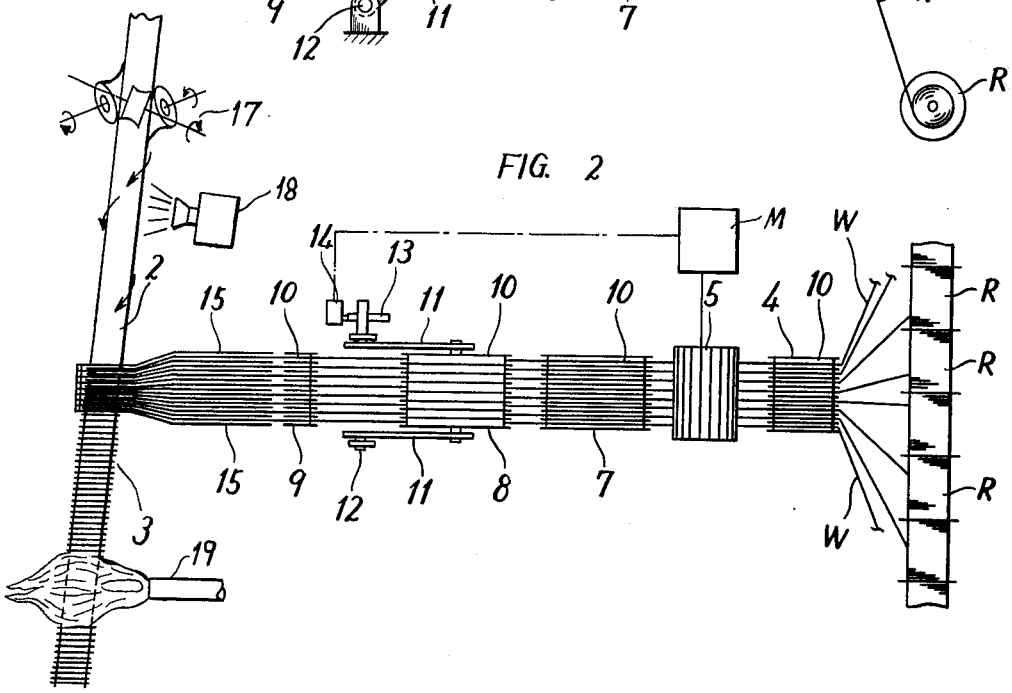
FIG. 2 is a schematic plan view of the apparatus of FIG. 1.

As shown in FIGS. 1 to 4, the apparatus of this invention comprises wire fin forming means, wire fin guiding means, tube feeding means, speed controlling means and welding means.

The wire fin forming means is constructed of a rear roll (4) having a multitude of circumferential grooves, a pair of gears (5)(6) rotatable about parallel axes and arranged to mesh with one another and which are driven by a motor M, an intermediate roll (7) having a corresponding multitude of circumferential grooves, a cushion roll (8) having a corresponding multitude of circumferential grooves and a front roll (9) having a corresponding multitude of circumferential grooves and arranged in that order as seen from a wire reel (R). The rolls 4, 7, 8 and 9 and the gears 4,5 are disposed in parallel with each other.

The front, rear and intermediate grooved rolls (9)(7)(4) and the cushion grooved roll (8) are each formed with a plurality of annular circumferential grooves (10) having an appropriate pitch on the circumference of the roll, the grooves (10) having a depth or dimension sufficient to engage the major portion of the height of the arch portion ($1_a$) of the wavy wire (1) therein.

The pair of gears (5)(6), which may be of any suitable sort, are selected and constructed to have a tooth profile and module suitable to form the straight wire W into the wavy wire (1). The gears (5)(6) serve to shape the hard copper wire (W) as payed out from the wire reel (R) and passed on the rear multi-grooved roll (4), as the wire passes between the interdigitated teeth of the gears whereby to form the wavy wire (1) having alternately recurring unit patterns of arch-shaped portions ($1_a$) and root bottom portions ($1_b$), which patterns extend in a straight fashion in the same plane. Thus, the wavy patterns, i.e. the arch-shaped portion and root bottom portion of the wire (1) are shaped conforming to the tooth profile of the gears (5)(6).

A plurality of the wavy wires (1) are then transferred via the intermediate roll (7) and the cushion roll (8) in that sequence to the front roll (9) while being engaged in and guided by the grooves of the respective rolls.

The cushion roll (8) is connected to an arm (11) which is oscillatably pivoted to a machine frame at the lower end thereof so as to be angularly oscillatable with respect to the frame. When the wavy wires (1) are withdrawn from the gears (5)(6) are led downwardly to the cushion roll (8) and then upwardly to the front roll (9), the cushion roll (8) serves to impose an adequate tension on the wavy wires by the oscillation action so as to urge the wires downwardly. At the lower end of the arm (11), a rotation axle (12) is journaled on the arm (11) and is provided with a cam (13) which is adapted to actuate a microswitch (14) connected to the gear driving motor M in ON-OFF operation.

When the cushion roll (8) descends to the lower limit position and the wavy wires (1) are loosened, the microswitch (14) is switched OFF to stop the driving motor M, whereas when the cushion roll (8) ascends up to the upper limit position and the wires become too strained, the microswitch (14) is switched ON to actuate the gear motor M. In this way, the automatic controlling operation ensures that an adequate tension can be maintained to the wavy wires (1) and the feeding amount of the hard copper wires (W) may be regulated to match the winding amount of the waved wires (1) upon subsequent winding.

The wire fin guiding means is constructed essentially of a plurality of guide plates (15) which are arranged in parallel spaced relationship with each other and disposed in association with the front end of the foregoing fin forming means.

The intervals between the guide plates (15) are determined to be of such a dimension that the wavy wires (1) can be smoothly passed through the spaces between the plates without collapse. The intervals at the inlet sides of the guide plates 15 correspond to the spacings of the groove of the front roll (9) and the intervals at the outlet sides of the guide plates 15 are diminished to a distance corresponding to the after-mentioned helix pitch. Thus, a plurality of the wavy wires (1) leaving the guide plates are convergently led forwardly with the arch-shaped portions ($1_a$) of the wires standing upright without collapse.

The wire fin guiding means extends, at the front end thereof, over and beyond the external circumference of the tube (2) which is to be wound with the wire fins. A bottom plate (16) is attached to the bottoms of the guide plates (15) in order to prevent the wavy wires from dropping out of the guide plates (15).

The tube feeding means 17 is a conventional type of one and serves to feed the revolving tube (2) in the axial direction of the tube. More specifically, the tube (2) is fed across the front end of the fin guiding means in a direction crossing obliquely to the advancing direction of the wavy wires and extending at right angles to the upstanding direction of the arch portions (1a).

The circumferential speed and the feeding speed of the pipe (2) may be determined appropriately and regulated so that the winding speed of the wavy wires may be equal to or slightly lower than the travelling speed of the wire fin forming means.

The welding means may be a heat oven surrounding the advancing tube (2) when the tube is preliminarily coated with solder. It includes a flux applying device (18) for jetting a flux or welding agent upon melting which is provided facing the advancing tube and a heating device (19) provided behind the flux applying device (18) where the tube is subjected to a brazing treatment.

To initiate the cyle of operation of the apparatus according to this invention, a plurality of wires are manually prepared beforehand to be in proper condition of operation. That is, the required number of the hard copper wires (W) are fed to the wire fin forming means, thus shaping the wavy wires (1) and, the wavy wires are passed through the wire fin guiding means and wound round the tube (2) once or twice at their terminals. Now, in that state, the gear driving motor and the tube feeding means are actuated, and the operation of the present apparatus proceeds automatically. The wavy wires (1) as continuously shaped with the aid of the pair of gears (5)(6), are passed through the fin guiding means and are delivered to the advancing revolving tube (2) while the arch-shaped portions ($1_a$) thereof are maintained in their upstanding state without collapsing. The wavy wires delivered are then helically wound around the tube (2) on its periphery, during which process a tension sufficient to stand the wire fins upright on the tube is exerted on the fins. Consequently, the wire fins are continuously formed as plural helixes on the tube (2) so that the arch-shaped portions ($1_a$) thereof protrude radially upright on the circumference of the tube and the root bottom portions ($1_b$) thereof are resiliently in contact with the surface of the tube.

The wire fins thus wound are welded securely to the tube by means of the welding means at their root bottom portion ($1_b$).

After welding, the resulting wire fins are in a state in which all the arch-like fins ($1_a$) are fixed upright and firmly at their roots, and they have a high resilience and toughness, so that the initial state can be maintained stably because an excessive stress is not applied thereto.

It is feasible to readily and appropriately regulate the helix pitch by varying the number of the wires to be used and the feeding speed of the tube feeding means.

Further, on account of the automatic speed control mechanism as mentioned above, the fin winding step can be performed in an orderly fashion under a constant tension.

Figure 5:
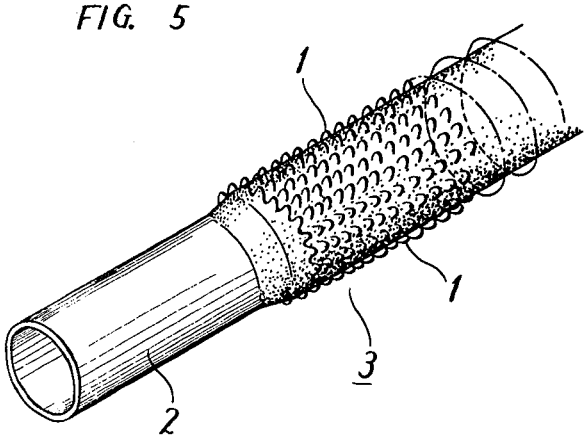
FIG. 5 is a perspective fragmentary view showing a wire fin tube obtained according to the apparatus of this invention.
Figure 3:
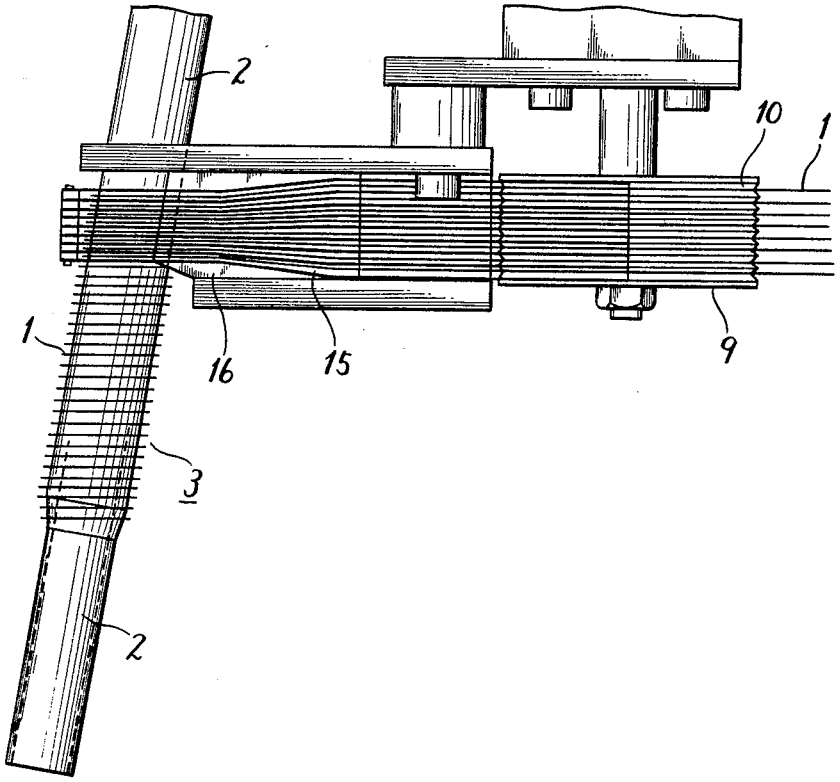
FIG. 3 is a plan view of the wire fin guiding means shown in FIG. 2.
Figure 4:
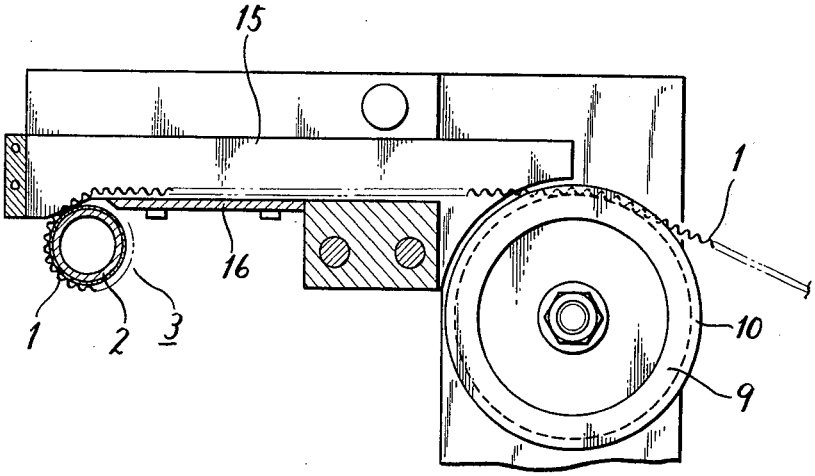
FIG. 4 is a sectional view of FIG. 3.

As shown in FIG. 5, the wire fin tube (3) for heat transfer is thus obtained.

The tables given below show various performances of the wire fin tubes obtained according to the operation of the present apparatus in comparison with those of conventional fin tubes.

The fin tubes according to this invention and according to prior art were applied to the inner tube of a tube-in-tube heat exchanger, of which the inner tube is coaxially coiled.

The comparative experiments were conducted on a condenser in which water was flowed at a rate of 1,682 l/hr through the inner tube in one passage way and a cooling medium of "Freon R-22" (monochloro-difluoro-ethylene) was flowed through the outer tube.

TABLE 1

| (Tube in tube condenser) | This Invention | | Prior Art | |
|---|---|---|---|---|
| | Smooth tube | Corrugated tube*6 | Edward fin tube (Smooth tube) | Low fin tube |
| Inner Tube | | | | |
| Tube Body Material | JIS C1220T*7 | | | |
| Diameter*1 · Thickness (mm) | 19.05 × 0.9 | | | |
| Effective Length*2 (m) | 2.7 | | | |
| Length (m) | 2.9 | | | |
| Heat Transfer Area*3 ($m^2$) | 0.1616 | | | |
| Fin Pitch (number/in.) | 31 | 31 | 31 | 19 |
| Fin Tube Diameter (mm) | 21.9 | 21.9 | 21.9 | 21.9 |
| Fin size*4 (mm) | 0.5 | 0.5 | 0.2 | — |
| Number of Inner Tube | 1 | 1 | 1 | 1 |
| Coil Radius of Inner Tube (mm) | 150 | 150 | 150 | 150 |
| Outer Tube | | | | |
| Outer Diameter · Thickness (mm) | 30 × 1.4 | | | |
| Cooling Water Amount (l/hr) | 1682 | 1682 | 1682 | 1682 |
| Cooling Water Speed (m/sec) | 2.0 | 2.0 | 2.0 | 2.0 |
| Cooling Water Temp. at Inlet (°C.) | 28.5 | 30.8 | 24.1 | 26.9 |
| Cooling Water Temp. at Outlet (°C.) | 33.9 | 36.1 | 29.4 | 32.2 |

TABLE 1-continued

| (Tube in tube condenser) | This Invention | | Prior Art | |
|---|---|---|---|---|
| | Smooth tube | Corrugated tube*6 | Edward fin tube (Smooth tube) | Low fin tube |
| Condensation Load (Kcal/hr) | 9000 | 9000 | 9000 | 9000 |
| Cooling Medium Saturation Temp. at Inlet Pressure (°C.) | 43 | 43 | 43 | 43 |
| Cooling Medium Pressure at Inlet ($Kg/cm^2$ . G) | 15.79 | 15.79 | 15.79 | 15.79 |
| Cooling Medium Gas Temp. at Inlet (°C.) | 80 | 80 | 80 | 80 |
| Cooling Medium Liq. Temp. at Outlet (°C.) | 34.4 | 34.4 | 34.6 | 34.1 |
| Coefficient of Overall Heat Transfer*5 ($Kcal/m^2$ . h . °C.) | 4800 | 6000 | 3450 | 4200 |
| Average Heat Transfer Coefficient*5 to Cooling Medium Side ($Kcal/m^2$ . h . °C.) | 12300 | 12300 | 6150 | 9000 |
| Average Heat Transfer Coefficient to Water Side ($Kcal/m^2$ . h . °C.) | 8860 | 13300 | 8860 | 8860 |
| Pressure Loss at Water Side (mAq) | 1.2 | 2.7 | 1.2 | 1.2 |
| Pressure Loss at Cooling Medium Side ($Kg/cm^2$) | 0.4 | 0.4 | 0.3 | 0.5 |

Remarks:
*1Diameter based on the tube body only (except the fin portions).
*2Length of the tube to which the fins are attached.
*3Area based on the tube body only (except the fins).
*4With the invention, it means the diameter of the fin wire and with the Edward fin tube, the thickness of the band.
*5Based on the heat transfer area of the tube body.
*6The pitch and depth of the corrugation are 21 mm/3 lines and 0.32 mm, respectively.
*7Copper tube according to Japanese Industrial Standards.

The results above apparently show that the heat transfer tubes according to this invention have values of the coefficient of heat transfer to the cooling medium side of about two times that of the Edward fin tube and of about 1.37 times that of the low fin tube. Hence, the fin tubes of this invention are much improved in heat exchange efficiency over the prior fin tubes in spite of the low pressure loss.

Similarly, comparative experiments were conducted on a condenser in which the fin tubes of this invention and the prior art fin tubes were applied to the tube of a shell and tube heat exchanger and cooling water was passed through the twenty-four tubes in eight-passage way and cooling medium of "Freon R-22" was passed through the shell.

The results are shown in Table 2 below.

TABLE 2

| (Shell and tube condenser) | This Invention | | Prior Art | |
|---|---|---|---|---|
| | Smooth tube | Corrugated tube** | Low fin tube | Low fin tube with interior helical projections*** |
| Tube | | | | |
| Tube Body Material | JIS C-1220-T* | | | |
| Diameter × Thickness* (mm) | 15.88 × 0.8 | 15.88 × 0.8 | 15.88 × | 15.88 × 0.55 |

TABLE 2-continued (Shell and tube condenser)

| | This Invention | | Prior Art | |
|---|---|---|---|---|
| | Smooth tube | Corrugated tube** | Low fin tube | Low fin tube with interior helical projections*** |
| | 0.8 | | 0.89 | |
| Effective Length* (m) | 11.66 | 11.66 | 11.66 | 11.66 |
| Total Length (m) | 571 | 571 | 571 | 571 |
| Fin Pitch(number/in.) | 31 | 31 | 26 | 26 |
| Fin Tube Diameter (mm) | 18.8 | 18.8 | 18.8 | 18.8 |
| Fin Diameter (mm) | 0.5 | 0.5 | — | — |
| Heat Transfer Area* ($m^2$) | 0.5817 | 0.5817 | 0.5817 | 0.5817 |
| Shell | | | | |
| Diameter × Thickness (mm) | 165.2 × 5.5 | 165.2 × 5.5. | 165.2 × 5.5 | 165.2 × 5.5 |
| Cooling Water Amount (l/hr) | 2600 | 2600 | 2600 | 2600 |
| Cooling Water Speed (m/sec) | 1.50 | 1.50 | 1.54 | 1.40 |
| Cooling Water Temp. at Inlet (°C.) | 31.38 | 32.72 | 30.25 | 31.47 |
| Cooling Water Temp. at Outlet (°C.) | 38.30 | 39.64 | 37.17 | 38.39 |
| Condensation Load (Kcal/h) | 18000 | 18000 | 18000 | 18000 |
| Condensation Temp. (°C.) | 43 | 43 | 43 | 43 |
| Condensation Pressure ($Kg/cm^2$ . G) | 15.79 | 15.79 | 15.79 | 15.79 |
| Cooling Medium Gas Temp. at Inlet (°C.) | 80 | 80 | 80 | 80 |
| Cooling Medium Liq. Temp. at Outlet (°C.) | 35 | 35 | 35 | 35 |
| Coefficient of Overall Heat Transfer* ($Kcal/M^2$, h . °C.) | 4050 | 5000 | 3500 | 4100 |
| Average Coefficient of Heat Transfer to Cooling Medium* ($Kcal/m^2$ . H . °C.) | 12750 | 10700 | 8700 | 6250 |
| Coefficient of Heat Transfer to Water ($Kcal/m^2$ . h . °C.) | 6700 | 10700 | 6700 | 13000 |
| Pressure Loss of Transfer Tube (mAq/m) | 0.22 | 0.44 | 0.24 | 0.39 |

Remarks:
*Same as Table 1 above (*1 *2 *3 *5 *7)
**The pitch and depth of the corrugation are 18 mm/30 lines and 0.25 mm, respectively.
***The pitch and height of the projections are 45 mm/6 lines and 0.56 mm, respectively.

The results above show that the wire fin tubes of this invention have much higher values in coefficient of heat transfer to cooling medium than the low fin tube and the low fin tube processed inside even though they have a lower coefficient of heat transfer to water than or the same value as the prior art fin tubes, so that with the wire fin tubes, the coefficient of overall heat transfer is, as a whole, improved over the prior fin tubes.

As thus far described, according to the apparatus of this invention, there are attained the advantages as described hereinafter.

Since a plurality of wires can be wound round a tube simultaneously, the efficiency and speed of the production is remarkably enhanced.

The fin forming means and tube feeding means are disposed at a distance unlike the case with conventional wire fin tube, so that even a wire fin tube of a low fin height, which might not be impossible with prior art, can be easily processed. Besides, it is possible to obtain the height of the fin as desired by freely choosing the gear profile of the fin forming means.

The heat transfer area of the fin tube can be increased or decreased freely depending upon the tube feeding pitch as required by merely varying the number of the wires to be delivered.

It is feasible to manufacture the heat transfer tube continuously by placing the speed of the wire fin forming means and the speed of the tube feeding means in cooperative relation to one another, so that the fins are distributed in an orderly fashion having a uniform shape and uniformity of the heat exchange properties in every portion of the fin tube can be assured.

It is also advantageous that the wire fin winding operation can be performed easily to any tube irrespective of the diameter of the tube only by regulating the revolution speed and feeding speed of the tube feeding means.

Owing to the fact that the wavy wire (1) upon winding assumes a two-dimentional shape consisting of the arch portions ($\mathbf{1}_a$) and root bottom portions ($\mathbf{1}_b$), which alternately extend recurrently in the same plane, and is exerted with an adequate tension thereon, even if the tube to be used has a somewhat uneven surface, the wavy wires can be wound securely around the tube, while being in contact with the surface of the tube. Accordingly, an externally corrugated tube as well as a smooth tube may be used.

Since wire is used as a fin material, a lesser amount of material is required for the manufacture of the fin tubes, which is economical. In this connection, the root bottom portions of the fins in contact with the tube are of a smaller area, so that the loss in heat transfer area is smaller and hence, fin tube of a high efficiency can be obtained.

Because of the high fin strength due to the good resilience and toughness of the arch-shaped fins of the wire fin tube, it is possible, after the production, to pile the fin tube articles up on each other for storage, and further coiling processing work of the fin tube can be done easily without collapsing of the fins.

It is further to be noted that the fin tube for heat transfer obtained according to the present invention has a good thermal transfer property toward the outside the tube with a low pressure loss to a fluid, and it is of such a fin construction that liquid droplets are not stagnated. Consequently, it is particularly preferred to use the fin tube as a tube-in-tube type of heat exchanger, for example condenser, evaporator, oil cooler or the like.

What we claim is:

1. An apparatus for producing a fin tube useful for heat transfer purposes, which comprises:

supply means for supplying a plurality of continuous wires having good thermal conductivity, said supply means comprising a rotatable rear roll having a plurality of axially spaced-apart, continuous, circumferentially extending, parallel, annular grooves in the periphery thereof for receiving and guiding said wires to form a frontwardly moving array of said wires in which said wires are positioned in side-by-side, parallel, substantially coplanar relationship;

wire fin forming means for receiving said array of said wires from said rear roll and shaping them, said wire fin forming means comprising a pair of rotatable gears positioned frontwardly of said rear roll and mounted for rotation about parallel axes which axes are also parallel with the axis of rotation of said rear roll and transverse to the lengthwise extents of said wires, said gears having interdigitated gear teeth for receiving therebetween said array of said wires and forming each of said wires into an upright, wavy shape composed of alternating arch-shaped upper portions and oppositely curved lower portions as said wires are moved frontwardly between said gears in side-by-side, parallel, substantially coplanar relationship;

a rotatable front roll positioned frontwardly of said pair of gears and mounted for rotation about an axis which is parallel with the axes of rotation of said gears, said front roll having a plurality of axially spaced-apart, continuous, circumferentially extending, parallel, annular grooves for receiving and guiding frontward movement of said array of wavy wires in side-by-side, parallel, substantially coplanar relationship with said arch-shaped upper portions being upright;

wire fin guiding means positioned frontwardly of said front roll for receiving and guiding frontward movement of said array of said wavy wires from said front roll, said wire fin guiding means comprising a plurality of upright guide plates positioned in parallel spaced-apart relationship so that the wavy wires of said array are guided between said plates with said arch-shaped upper portions remaining upright;

tube feedng means for feeding a revolving tube across the frontward end of said wire fin guiding means in a direction transverse to the direction of frontward movement of said array of said wavy wires whereby said wavy wires are helically wound around said revolving tube with said lower portions of said wavy wires being disposed adjacent said tube and the remainders of said wavy wires extending upwardly therefrom;

speed controlling means for regulating the relationship between the operating speed of said fin forming means and the operating speed of said tube feeding means so that tension is applied to said wavy wires to maintain said wires in an upright state as said wires move from said wire fin forming means over said front roll and through said wire fin guiding means; and welding means for affixing to said tube said lower portions of said wavy wires wound on said tube, whereby to form helical, integral, upright, wire fins on said tube.

2. An apparatus according to claim 1 in which the depths of said annular grooves in said front roll are sufficient that the major portion of the height of said upright wavy wires can be received therein.

3. An apparatus according to claim 1 or claim 2, including a driving motor for rotating said gears, and said speed controlling means comprises means for turning off and turning on said motor.

4. An apparatus according to claim 3 including a rotatable cushion roll positioned between said gears and said front roll, said cushion roll being rotatable about an axis of rotation parallel with the axes of rotation of said gears, said cushion roll being disposed to overlie said array of said wavy wires, said cushion roll having a plurality of axially spaced-apart, continuous, circumferentially extending, parallel, annular grooves in the periphery thereof for receiving and guiding said array of wavy wires in side-by-side, parallel relationship, lever means mounting said cushion roll for oscillation in a vertical plane so that said cushion roll can move upwardly and downwardly to maintain tension on said wavy wires, and switch means responsive to said cushion roll reaching an upper limit position to turn on said motor and thereby rotate said gears and responsive to said cushion roll reaching a lower limit position to turn off said motor and thereby stop rotation of said gears.

5. An apparatus according to claim 4 in which, in said wire fin guiding means, the forward ends of said guide plates converge in the frontward direction.

* * * * *